US011759013B2

(12) United States Patent
Pierpont

(10) Patent No.: US 11,759,013 B2
(45) Date of Patent: Sep. 19, 2023

(54) FURNITURE ANCHORS AND PROTECTORS

(71) Applicant: Paul Pierpont, Pleasant Grove, UT (US)

(72) Inventor: Paul Pierpont, Pleasant Grove, UT (US)

(73) Assignee: Tip-Not L.L.C., Pleasant Grove, UT (US)

( * ) Notice: Subject to any disclaimer, the term of this patent is extended or adjusted under 35 U.S.C. 154(b) by 16 days.

(21) Appl. No.: 17/233,345

(22) Filed: Apr. 16, 2021

(65) Prior Publication Data

US 2021/0321773 A1 Oct. 21, 2021

Related U.S. Application Data

(60) Provisional application No. 63/010,936, filed on Apr. 16, 2020.

(51) Int. Cl.
*A47B 97/00* (2006.01)

(52) U.S. Cl.
CPC ..... *A47B 97/00* (2013.01); *A47B 2097/008* (2013.01)

(58) Field of Classification Search
CPC ..... A47B 97/00; A47B 2097/008
USPC ..... 248/205.3, 683
See application file for complete search history.

(56) References Cited

U.S. PATENT DOCUMENTS 3,311,338 A 3/1967 Culley
4,875,259 A * 10/1989 Appeldorn ..... B23Q 16/08 24/584.1
5,360,270 A * 11/1994 Appeldorn ..... A44B 18/0053 229/102
6,120,867 A 9/2000 Hamerski et al.
10,905,241 B1 * 2/2021 Stravitz ..... A47B 91/12
10,939,761 B1 * 3/2021 Stravitz ..... A47B 97/00
2003/0161984 A1 * 8/2003 Bries ..... A47G 1/175 428/40.1

FOREIGN PATENT DOCUMENTS

CN 1097081 C 12/2002

OTHER PUBLICATIONS

USPTO acting as International Searching Authority, "International Search Report and Written Opinion," International Application No. PCT/US2021/027823, dated Sep. 1, 2021.

* cited by examiner

*Primary Examiner* — Todd M Epps
(74) *Attorney, Agent, or Firm* — DENTONS Durham Jones Pinegar

(57) ABSTRACT

An apparatus that may anchor and/or protect furniture includes a compressible element and an adhesive material on opposite sides of the compressible element. The compressible element, which may comprise an expandable polyurethane foam, and the adhesive material may enable the apparatus to be secured to a piece of furniture and a wall and, when secured in position, to withstand pulling forces of at least about 50 pounds. Thus, the apparatus may prevent furniture from tilting and falling away from the wall. The adhesive material may also be removable from the surface of a wall while leaving substantially no residue or no residue on the surface of the wall. Methods for securing furniture to walls are also disclosed, as are apparatuses and methods for preventing furniture from damaging walls.

20 Claims, 8 Drawing Sheets

FURNITURE ANCHORS AND PROTECTORS

CROSS-REFERENCE TO RELATED APPLICATION

A claim for priority to the Apr. 16, 2020 filing date of U.S. Provisional Patent Application No. 63/010,936, titled FURNITURE TILT PREVENTION ("the '936 Provisional Application") is hereby made pursuant to 35 U.S.C. § 119(e). The entire disclosure of the '936 Provisional Application is hereby incorporated herein.

TECHNICAL FIELD

This disclosure relates to techniques and apparatuses that may anchor and/or protect furniture. More specifically, the techniques and apparatuses of this disclosure may be used to prevent furniture from tilting away from a wall against which the furniture is positioned and from falling. The techniques and apparatuses of this disclosure may also prevent furniture from knocking against the wall against which it is positioned. Even more specifically, this disclosure relates to the adhesion of compressible elements to a surface of a piece of furniture (e.g., the backside of the piece of furniture, etc.) that is to be placed against a wall; the compressible elements may also be secured to the wall.

RELATED ART

Furniture, such as dressers, bookshelves, television stands, and the like, may tip over as it becomes unstable. Furniture often becomes unstable as an individual climbs on the front of a piece of furniture, exerting a forward and downward force on the piece of furniture. While people of all ages may climb up or onto a piece of furniture for any of a variety of reasons, furniture tip-overs can be most devastating to children—especially toddlers; an estimated two-thirds of tip-over incidents involve children who are one to three-and-a-half years old. The force of impact as a piece of furniture falls on an individual may injure the individual. The weight of the piece of furniture may make it difficult—even impossible—for the individual to remove the furniture from himself or herself, sometimes suffocating the individual. It has been estimated that furniture tip-overs involving children occur about 40 times each day in the United States, resulting in two or three deaths every month.

The frequency with which furniture tip-overs occur has led to massive recalls of certain makes, types, and models of furniture. In addition, various measures have been taken to prevent furniture from tipping over. For example, screws or bolts may be used to secure solid brackets in place to a piece of furniture and to the wall to which the piece of furniture is to be anchored. As another example, nylon tethers may be screwed or bolted to the back of a piece of furniture and to the wall against which the piece of furniture is positioned. These and other existing furniture anchoring techniques require that holes be formed in the wall. The anchors or tethers are often visible, which may detract from the appearance of the furniture.

External forces may also force furniture against a wall against which it is positioned. As the furniture is forced against the wall, the sudden impact or prolonged contact may damage the furniture and/or the wall.

SUMMARY

A method for preventing furniture from tilting away from a wall against which the furniture is positioned and from falling includes securing a securing strip that includes a compressible element between a wall and a backside of a piece of furniture. More specifically, such a method may include positioning a securing strip that includes an elongated compressible element between the backside of the furniture and the wall, filling a portion of a gap between the backside of the furniture and the wall. A front side of the elongated compressible element may be adhesively secured to a top portion of the backside of the furniture. A backside of the elongated compressible element may be secured to the wall.

The elongated compressible element of the securing strip be compressible. More specifically, the elongated compressible element may be compressible across, or transverse to, its thickness, or a distance between the front side and the backside of the elongated compressible element. In some embodiments, the elongated compressible element may also be able to expand, for example, across its thickness.

The thickness of the elongated compressible element may be sufficient to extend across a gap between the backside of the furniture and the wall (e.g., due to the presence of a base molding at the base of the wall, because the furniture is not level, because the wall is not plumb, etc.). A compressibility of the elongated compressible element may enable the thickness of the elongated compressible element to be reduced to enable the elongated compressible element to be used in gaps between the backside of the furniture and the wall that are less than the thickness of the elongated compressible element.

The elongated compressible element may have a length that enables it to extend substantially across the backside of the furniture. In some embodiments, a plurality of elongated compressible elements may be used in an end-to-end, or inline, arrangement across at least a portion of the backside of the furniture.

The elongated compressible element may comprise one or more strips of foam. The elongated compressible element may be able to withstand (e.g., resist failure, such as tearing, etc.) when a pulling force of at least 50 pounds (about 22.7 kg), at least 75 pounds (about 34.1 kg), or at least 100 pounds (about 45.4 kg) is applied thereto. The elongated compressible element may be made from a polyurethane foam. The foam may be an expanding foam, such as an expandable polyurethane foam.

In some embodiments, the elongated compressible element may include one or more reinforcing threads. Without limitation, the elongated compressible element may include one or more threads of poly-paraphenylene terephthalamide, which is available under the KEVLAR® trademark. Such a thread may follow a serpentine path through the thickness of the elongated compressible element, such that it extends partially over the backside of the elongated compressible element, through the thickness or width of the elongated compressible element, partially over the front side of the elongated compressible element, back through the width of the elongated compressible element, etc., along at least a portion of a length of the elongated compressible element (e.g., from one end the elongated compressible element to the other end of the elongated compressible element, etc.). Alternatively, a reinforcing thread may be located between a side of the elongated compressible element and the adhesive material on the side of the elongated compressible element (e.g., it may extend substantially straight along the length of the elongated compressible element, it may follow a serpentine path, it may be looped, etc.).

One or both of the front side and the backside of the elongated compressible element may carry an adhesive element, such as an adhesive coating. An adhesive material of the adhesive element may have sufficient tackiness to remain secured to the wall and/or the backside of the furniture when a pulling force of up to 50 pounds (about 22.7 kg) (the standard for anchoring furniture) is applied across the length of the elongated compressible element (e.g., 11 inches (about 28 cm), 12 inches (about 30 cm), 17 inches (about 43 cm), 18 inches (about 45 cm), etc.). In some embodiments, a tackiness of the adhesive material may enable it to remain secured to the wall and/or the backside of the furniture when up to about 75 pounds (about 34.1 kg) of pulling force, up to about 100 pounds (about 45.4 kg) of pulling force, or more than 100 pounds of pulling force is applied to the elongated compressible element. It should be noted, however, that this discussion of results that have been achieved during testing is not a guarantee that an apparatus, system, or method disclosed herein will prevent a piece of furniture from tipping or falling under these or any amounts of pulling force. It should also be noted that the ability of the elongated compressible element and the adhesive elements thereon to prevent a piece of furniture from tipping and from falling may be limited by the manner in which and/or extent to which the furniture manufacturer has secured a backside of a piece of furniture to the remainder of the piece of furniture. Use of an elongated compressible element and adhesive elements according to this disclosure may not prevent a piece of furniture from tipping or falling if a backside of the piece furniture is not adequately secured to a remainder of the piece of furniture (e.g., by the manufacturer, by loosening due to conditions to which the piece of furniture is subjected, by loosening over time, etc.).

In addition, the adhesive material may be removed from a wall and from a backside of a piece of furniture without damaging the wall (e.g., the drywall, paint on the drywall, etc.) and, in some embodiments, while leaving substantially no residue on the wall or the backside of the piece of furniture. Without limitation, the acrylic material of the adhesive element may comprise an acrylic adhesive, for example, a conformable acrylic adhesive.

In some embodiments, a manner in which the backside of the furniture is secured to a remainder of the furniture may be reinforced. Without limitation, one or more fasteners (e.g., screws, nails, tacks, etc.) may be used to reinforce the manner in which a backside of a piece of furniture is secured to a remainder of the furniture. By reinforcing the manner in which the backside of a piece of furniture is secured to a remainder of the furniture, the likelihood that the backside of the piece of furniture is pulled away from the remainder of the piece of furniture as an elongated compressible element and the adhesive on the front side and backside thereof secure the backside of the piece of furniture to a wall while a forward and downward force is exerted on the furniture.

When a force is exerted on the furniture in a forward and downward direction, adhesive on the front side of the elongated compressible element, the elongated compressible element, and adhesive on the backside of the compressible element may prevent the furniture from tipping away from the wall. More specifically, the elongated compressible element and the adhesive on the front side and backside thereof may be used to prevent the furniture from tilting forward and falling when a force of up to about 50 pounds (about 22.7 kg), up to about 75 pounds (about 34.1 kg), up to about 100 pounds (about 45.4 kg), or more is exerted thereon in a forward and downward direction.

In another aspect of this disclosure, a system for preventing furniture from tilting includes a securing strip with an elongated compressible element having a front side and a backside, adhesive on the front side of the elongated compressible element, adhesive on the backside of the elongated compressible element, and instructions for securing the elongated compressible element between a backside of a piece of furniture and a the wall in a manner that will prevent the piece of furniture from tilting away from the wall. In some embodiments, such a system may also include a plurality of fasteners (e.g., screws, nails, tacks, etc.). Fasteners may be used to enable a consumer to try to reinforce a manner in which the backside of the piece of furniture is secured to the remainder of the piece of furniture; however, the use of such fasteners does not guarantee that the backside of a piece of furniture will remain secured to a remainder of the piece of furniture when an elongated compressible element and adhesive according to this disclosure secure the piece of furniture to a wall and forward and downward forces are applied to the piece of furniture.

An embodiment of a method for manufacturing a securing strip according to this disclosure may include extruding an elongated compressible element and concurrently applying an adhesive coating to a front side and a backside of the newly formed elongated compressible element as it emerges from and extrusion die. Extrusion may occur as a thread (e.g., a KEVLAR® thread, etc.) moves through a length of the elongated compressible element (e.g., through a center of, back and forth or from side-to-side through the elongated compressible element, resulting in a thread that follows a serpentine or winding path through the thickness of width of the elongated compressible element, etc.).

As an alternative to a securing strip that includes an elongated compressible element, a shorter securing pad may include a short compressible element, as well as adhesive material on opposite sides thereof. One or more shorter securing pads may be used in a manner similar to the use of an elongated compressible element, but on narrower, taller, or irregularly shaped items to secure them in place against a wall.

In other embodiments, an adhesive material may be present on only one side of a short compressible element to provide a protective pad. The adhesive material may secure the protective pad to a backside of a piece of furniture to cushion the piece of furniture and the wall against which it is positioned as the piece of furniture is forced against the wall. Alternatively, the adhesive material may secure the protective pad to a wall at a location against which a piece of furniture is to be placed. One or more protective pads may be used to cushion against contact between a piece of furniture and a wall.

Other aspects of this disclosure, as well as features and advantages of various aspects of the disclosed subject matter, should become apparent to those of ordinary skill in the art through consideration of the ensuing description, the drawings, and the accompanying claims.

DETAILED DESCRIPTION

Figure 1:
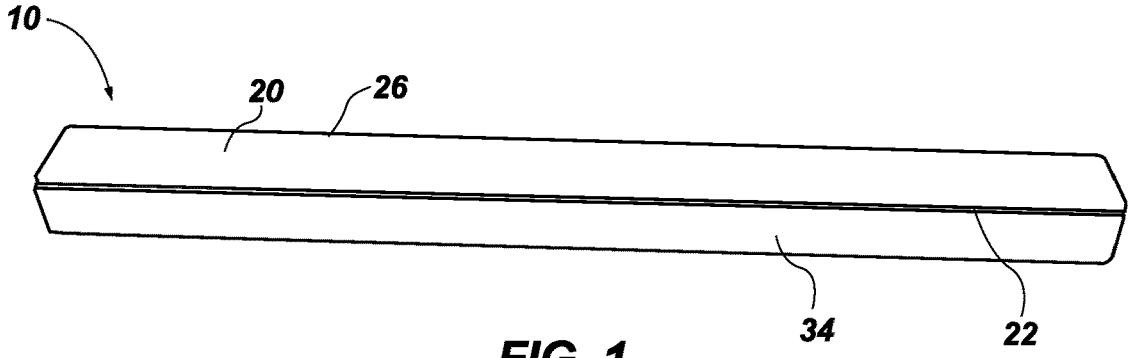
FIG. 1 is a perspective view of an embodiment of a securing strip.
Figure 2:
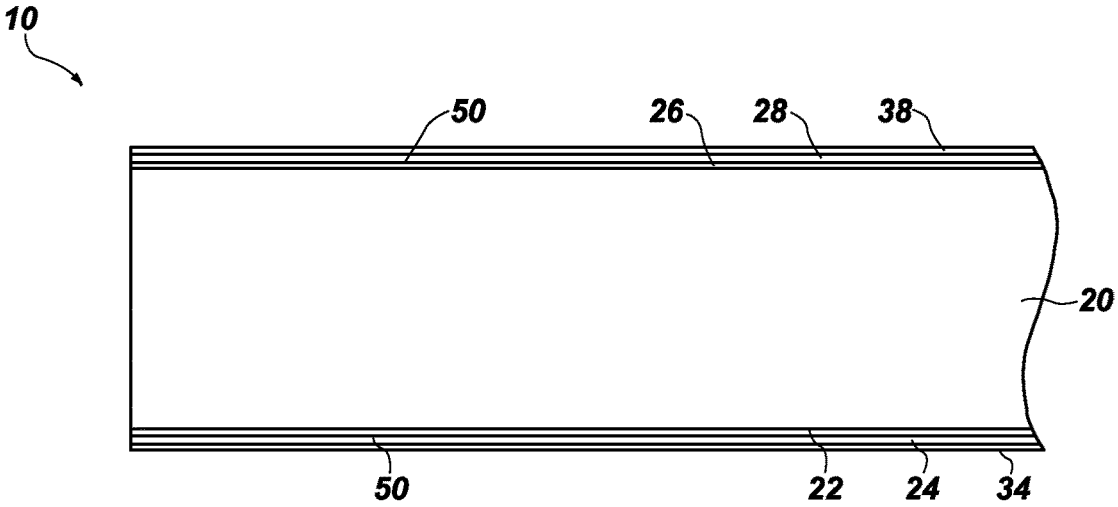
FIG. 2 is a top view of the embodiment of securing strip shown in FIG. 1.

FIGS. 1-4 show embodiments of securing strips 10, each of which includes an elongated compressible element 20 with a first side 22 and a second side 26, which face in opposite directions. Each securing strip 10 includes a first adhesive material 24 on the first side 22 of the elongated compressible element 20 and a second adhesive material 28 on the second side 26 of the elongated compressible element 20. Additionally, each securing strip 10 may include a first release liner 34 over the first adhesive material 24 and a second release liner 38 over the second adhesive material 28.

The elongated compressible element 20 comprises a compressible material. A thickness of the elongated compressible element 20, or the distance between the first side 22 and the second side 26 of the elongated compressible element 20, may compress or decrease as one or both of the first side 22 and the second side 26 is forced toward the other of the first side 22 and the second side 26 (i.e., as a compressive force is applied to one of both of the first side 22 and the second side 26). The elongated compressible element 20 may also be elastic, or able to expand. For example, a thickness of the compressible element 20 may resiliently expand as one or both of the first side 22 and the second side 26 is pulled away from the other of the first side 22 and the second side 26.

In addition, the elongated compressible element 20 can withstand (e.g., resist failure, such as tearing, etc.) a force of at least 50 pounds (about 22.7 kg) (e.g., across a length of 11 inches (about 28 cm), a length of 12 inches (about 30 cm), a length of 17 inches (about 44 cm), a length of 18 inches (about 45 cm), etc.) pulling its first side 22 and its second side 26 away from each other. In some embodiments, the elongated compressible element 20 may be able to withstand a pulling force of at least 75 pounds (about 34.1 kg), at least 100 pounds (about 45.4 kg), or greater across its length.

The elongated compressible element 20 may be made from a foam. The foam may be an expanding foam. Without limitation, an expandable polyurethane foam may be used to form the elongated compressible element 20. In some embodiments, the foam may be impregnated with a water based, acrylic modified asphalt emulsion (AST Hi Acrylic) or a water based, acrylic impregnation (MST). In a specific embodiment, the elongated compressible element 20 may be made from Emseal expanding foam sealant tape.

While the elongated compressible element 20 may have any of a variety of different dimensions, in some embodiments, the elongated compressible element 20 may have a thickness (i.e., a dimension between its first surface 22 and its second surface 26) of about two inches (about 5 cm) and a height (i.e., a dimension transverse to both the thickness and the length of the elongated compressible element 20) of about one inch (about 2.5 cm) (i.e., it may comprise a length of a 1×2 inch foam, or length of about 2.5 cm×about 5 cm foam). Alternatively, the elongated compressible element 20 could have a thickness of about two inches and a height of about two inches (about 5 cm) (i.e., it may comprise a length of 2×2 inch foam, or a length of about 5 cm×about 5 cm foam). In a specific embodiment, the elongated compressible element 20 may have a length of 11 inches (about 28 cm), a thickness of two inches (about 5 cm), and a height of one inch (about 2.5 cm).

The adhesive material 24, 28 may comprise a coating of an adhesive material or an adhesive element that has been secured to its respective side 22, 26 of the elongated compressible element 20. The adhesive material 24, 28 may comprise a pressure-sensitive adhesive material that may be removed from the backside of a piece of furniture and/or from a wall while leaving no residue or substantially no residue on the surface from which it is removed. As an alternative to using one adhesive material as both adhesive material 24 and adhesive material 28, different adhesive materials may be used. For example, the adhesive material 24 that secures the elongated compressible element 20 to the backside of a piece of furniture may comprise a permanent adhesive, while the adhesive material 28 that secures the elongated compressible element 20 to a wall may reversibly adhere to the wall.

The adhesive material 24, 28 may have sufficient tackiness to remain secured to the wall and/or the backside of the furniture when a pulling force of up to 50 pounds (about 22.7 kg) (the standard for anchoring furniture) is applied across the length of the elongated compressible element 20. In some embodiments, a tackiness of the adhesive material 24, 28 may enable it to remain secured to the wall and/or the backside of the furniture when up to about 75 pounds (about 34.1 kg) of pulling force, up to about 100 pounds (about 45.4 kg) of pulling force, or more than 100 pounds of pulling force is applied across the width of the elongated compressible element 20 (i.e., pulling the first side 22 and the second side 26 away from each other).

Without limitation, an acrylic adhesive material may be used as the adhesive material 24, 28. In a specific embodiment, the adhesive material 24, 28 may comprise SCOTCH Extreme Mounting Tape, available from 3 M, which comprises a conformable acrylic adhesive.

The release liners 34 and 38 may comprise any suitable material that will adhere to and protect the adhesive materials 24 and 28 on the surfaces 22 and 26, respectively, of the elongated compressible element 20. The release liners 34 and 38 may also be readily removable from (e.g., peelable away from, etc.) the adhesive materials 24 and 28 when adhesion of the elongated compressible element 20 to the backside of a piece of furniture or a wall is desired.

In some embodiments, the securing strip 10 may also include one or more reinforcing threads 50. Without limitation, each reinforcing thread 50 may comprise a thread of poly-paraphenylene terephthalamide, which is available under the KEVLAR® trademark. Such a reinforcing thread 50 may be carried by the elongated compressible element 20. As an example, a reinforcing thread 50 may extend through the adhesive material 24, 28 on the side 22, 26 of the elongated compressible element 20. As another example, a reinforcing thread 50 may be located between a side 22, 26 of the elongated compressible element 20 and the adhesive material 24, 28 on the side 22, 26 of the elongated compressible element 20 (e.g., it may extend substantially straight along the length of the elongated compressible element, it may follow a serpentine path, it may be looped, etc.). As yet another example, a reinforcing thread 50 may extend through the elongated compressible element 20 (e.g., along a substantially straight path through at least a portion of the length of the elongated compressible element 20, from side 22 to side 26, etc.).

Figure 5:
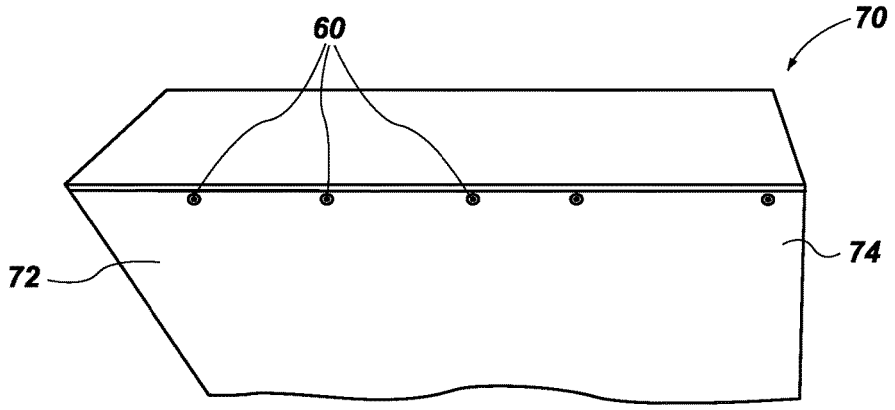
FIG. 5 depicts a backside of an embodiment of a piece of furniture, with fasteners having been added to the backside to further secure the backside to a remainder of the piece of furniture.

Referring now to FIGS. 3-10, an embodiment of a method for using a securing strip 10 is described. Optionally, as illustrated by FIG. 5, one or more fasteners 60 may be used to reinforce the manner in which a backside 72 of a piece of furniture 70 is secured to a remainder of the piece of furniture 70. As an example, each fastener 60 may comprise a screw, a tack, or the like, that may be introduced through a peripheral portion 74 of the backside 72 and into an adjacent surface of a remainder of the piece of furniture 70.

Figure 3:
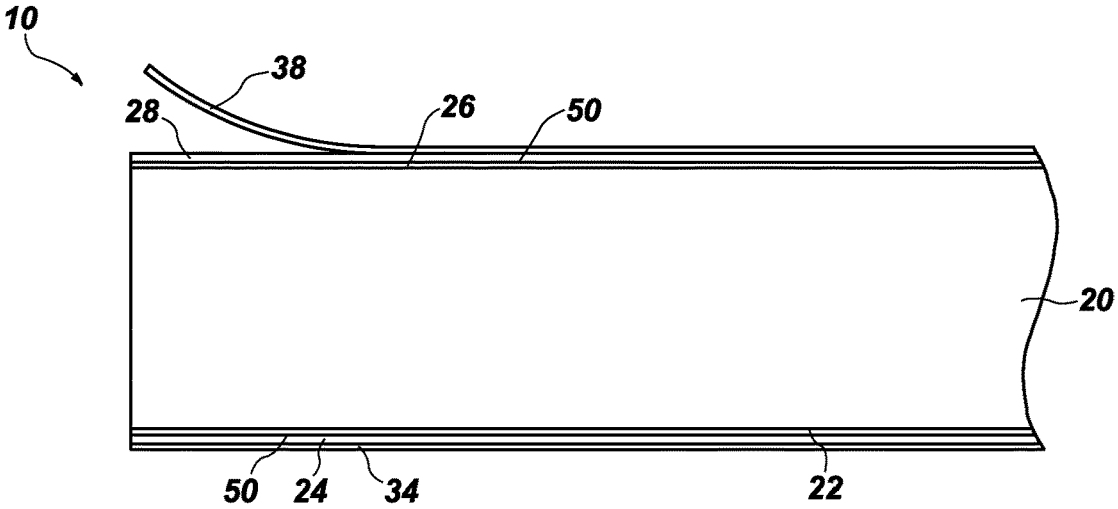
FIG. 3 is another top view of the embodiment of securing strip shown in FIG. 1, illustrating the removal of a release liner from an adhesive material on a first side of the securing strip.
Figure 4:
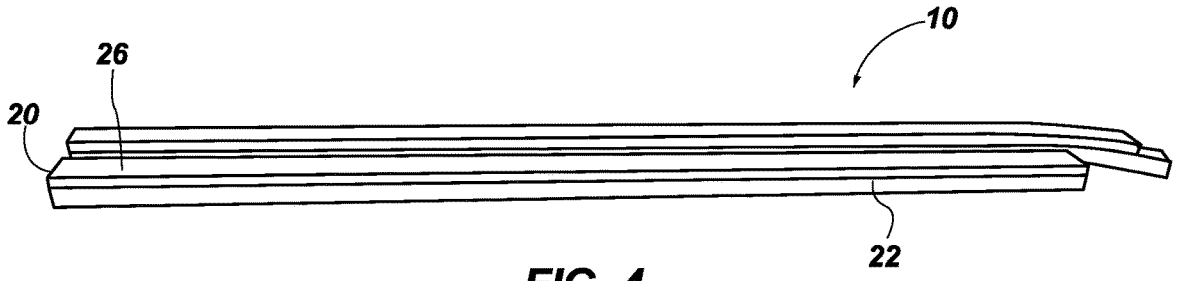
FIG. 4 illustrates an embodiment of a securing strip with release liners removed from adhesive materials on both a first side and a second side of the securing strip.
Figure 6:
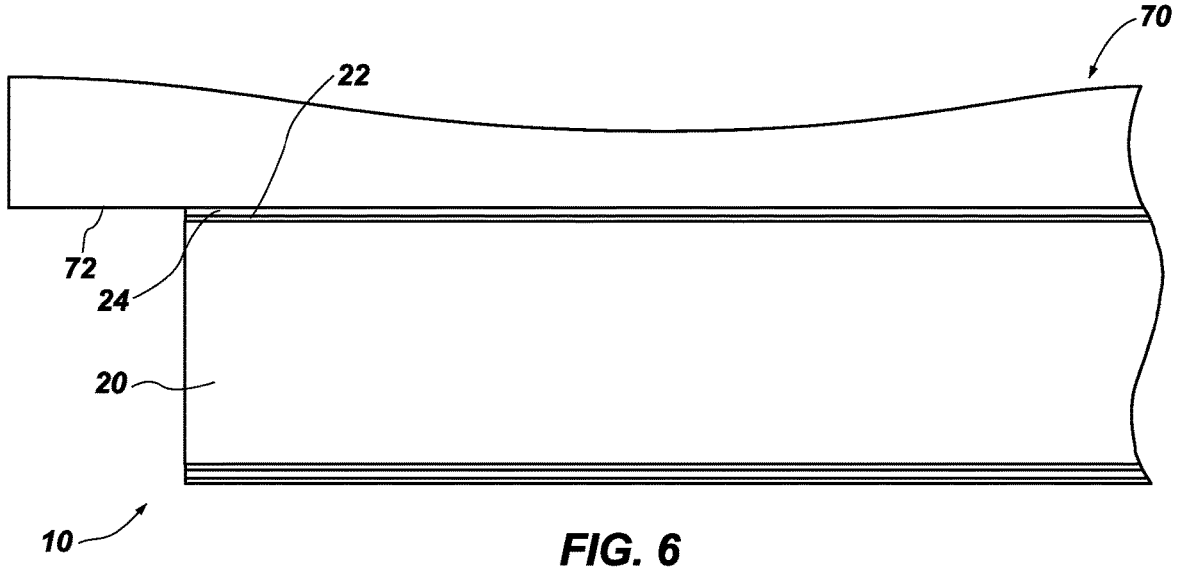
FIG. 6 shows the embodiment of securing strip shown in FIG. 1 on the backside of a piece of furniture, with the adhesive material on the first side of the securing strip securing the securing strip to the backside.

Next, as shown in FIG. 3, the release liner 34 may be removed from the adhesive material 24 on the first side 22 of the elongated compressible element 20 of the securing strip 10. With the adhesive material 24 exposed, it may be applied to the backside 72 of the piece of furniture 70, as illustrated by FIG. 6, securing the first side 22 of the elongated compressible element 20 and, thus, the securing strip 10 to the backside 72 of the piece of furniture 70.

Figure 7:
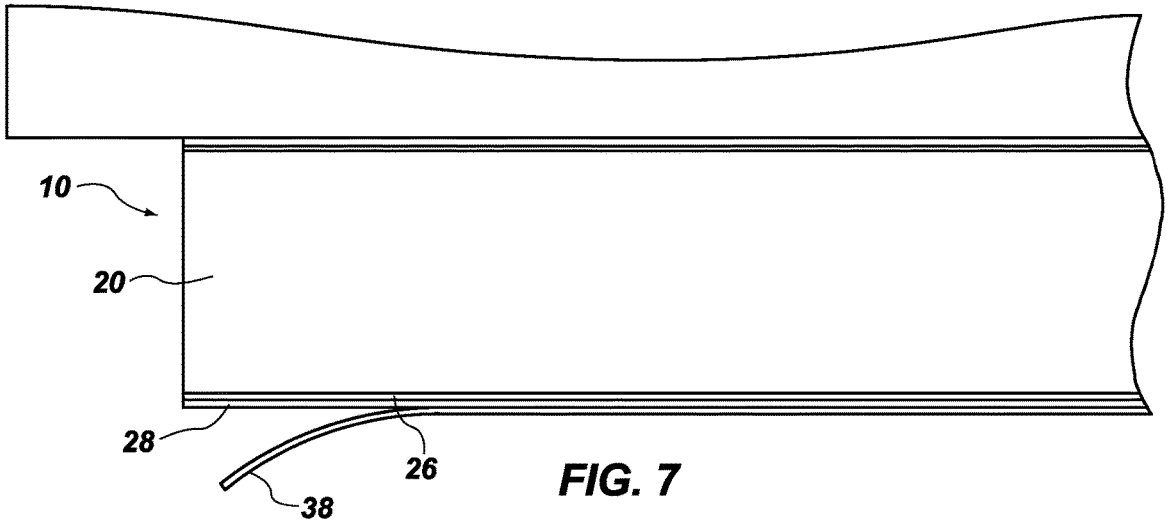
FIG. 7 illustrates the removal of a release liner from the adhesive material on the second side of the securing strip.
Figure 8:
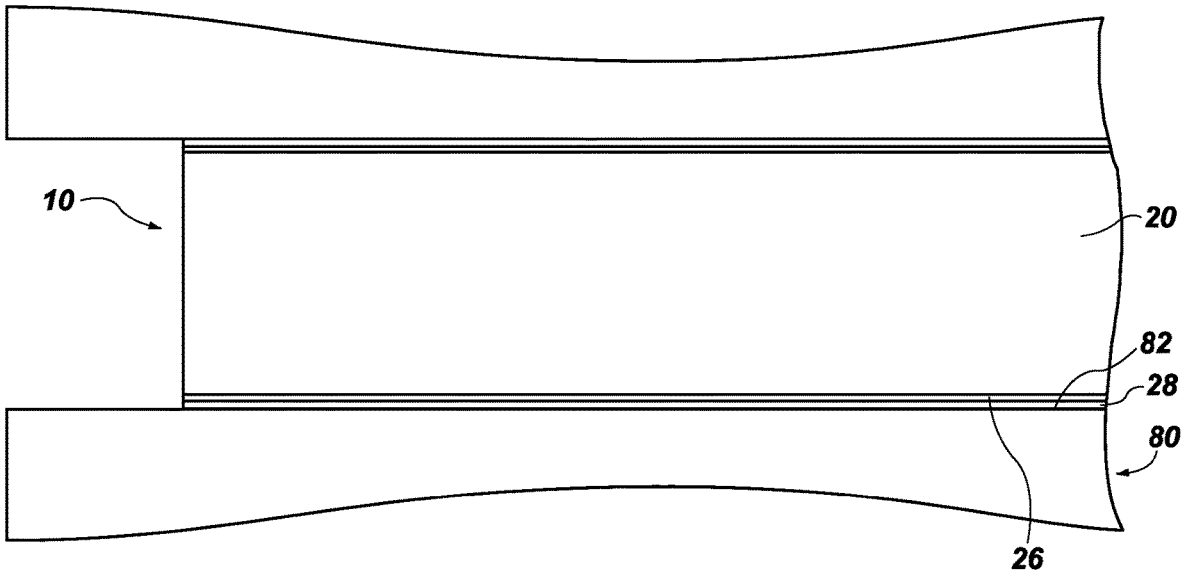
FIG. 8 depicts placement of the piece of furniture of FIG. 6 against a wall, with the adhesive material on the second side of the securing strip securing the securing strip and the piece of furniture to the wall.

As depicted by FIG. 7, the release liner 38 may be removed from the adhesive material 28 on the second side 26 of the elongated compressible element 20 of the securing strip 10. With the adhesive material 28 exposed, it may be applied to the surface 82 of a wall 80, as illustrated by FIG. 8, securing the second side 26 of the elongated compressible element 20 and, thus, the securing strip 10 to the surface 82 of the wall 80.

Figure 9:
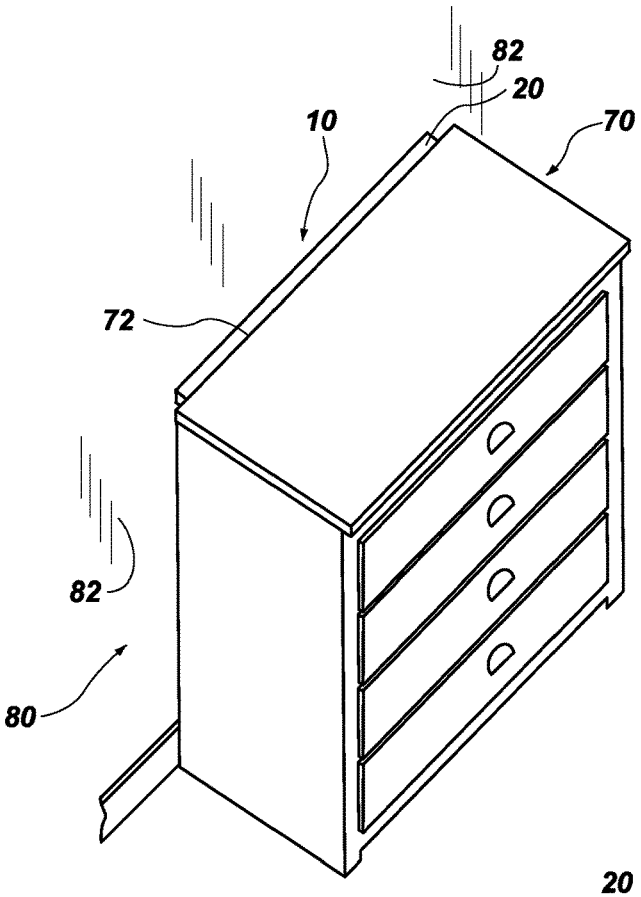
FIGS. 9 and 10 show the securing strip between the piece of furniture and the wall.
Figure 10:
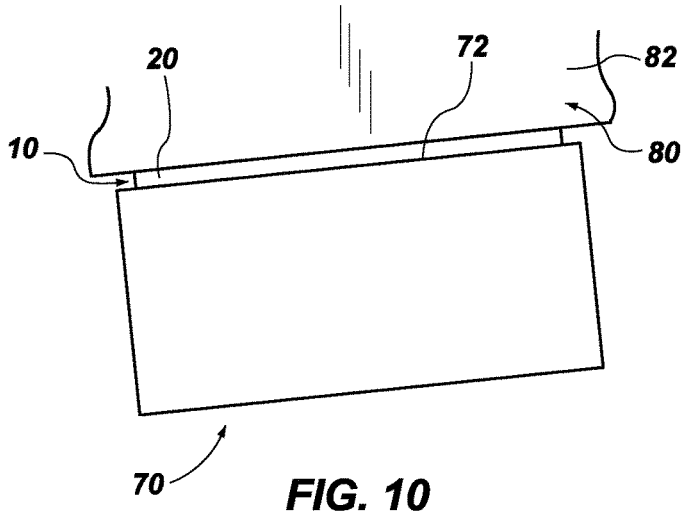

FIGS. 9 and 10 illustrate an embodiment of the manner in which a securing strip 10 may secure a top portion of the backside 72 of the piece of furniture 70 to the surface 82 of the wall 80. Notably, the thickness of the securing strip 10 fills a space between the backside 72 of the piece of furniture 70 and the surface 82 of the wall 80. The compressibility of the elongated compressible element 20 of the securing strip 10 enables the backside 72 of the piece of furniture 70 to be pushed as close as possible to the surface 82 of the wall 80 to minimize spacing between the backside 72 of the piece of furniture 70 and the surface 82 of the wall 80. In addition, the elongated compressible element 20 may form a barrier that prevents small objects from falling between the backside 72 of the piece of furniture 70 and the surface 82 of the wall 80 against which the piece of furniture 70 is positioned.

Figure 11:
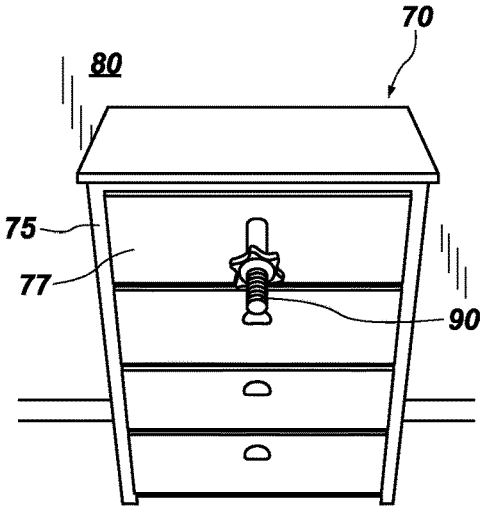
FIGS. 11-18 illustrate the results various experiments conducted to demonstrate the ability of securing strips according to this disclosure to adhesively secure a piece of furniture to a wall.

Turning now to FIGS. 11-18, various tests were performed to determine the effectiveness of the securing strips 10. As shown in FIG. 11, a barbell bar 90 with a weight of five pounds (about 2.27 kg) was introduced through and secured to a front panel 77 of the top drawer 75 of a dresser (i.e., a piece of furniture 70). Before securing the piece of furniture 70 to the wall 80 against which it was positioned, about 40 pounds (about 18.2 kg) of weight (not shown in FIG. 11) was attached to the barbell bar 90. The weight 92 caused the piece of furniture 70 to tilt and fall away from the wall 80.

The weight 92 was then removed from the barbell bar 90 and a securing strip 10 was applied to the backside 72 of the piece of furniture 70 and the surface 82 of the wall 80 in the manner described in reference to FIGS. 3-10 to secure the piece of furniture 70 to the wall 80. With the piece of furniture 70 secured to the wall 80, another weight (not shown in FIG. 11) of about 50 pounds (about 22.7 kg) was placed on the barbell bar 90. The piece of furniture 70 remained upright, even after several hours.

Figure 12:
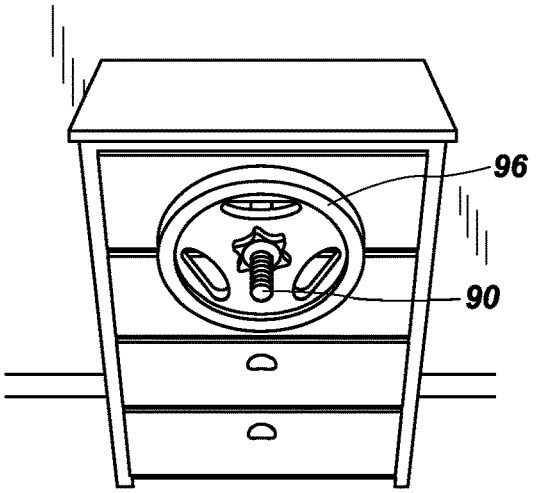
Figure 13:
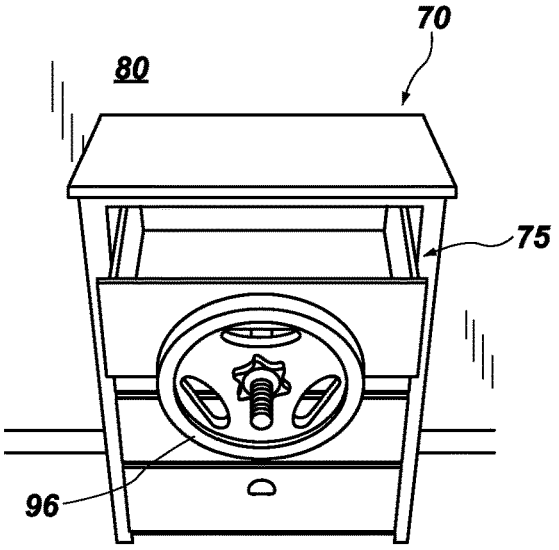
Figure 14:
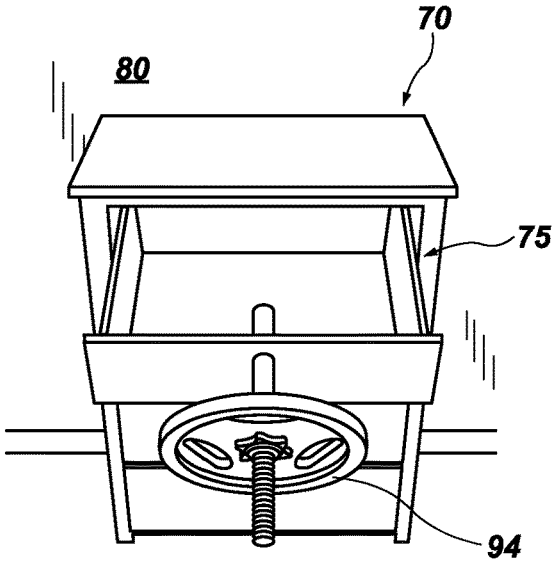

Next, as shown in FIG. 12, a weight 96 of 25 pounds (about 11.36 kg) was secured to the barbell bar 90, for a total force of about 30 pounds (about 13.64 kg). As illustrated by FIG. 13, the top drawer 75 was opened and the piece of furniture 70 remained in place against the wall 80. In FIG. 14, the weight 96 was replaced with another weight 94 of 50 pounds (about 22.7 kg) weight, for a total of about 55 pounds (about 25 kg). When the top drawer 75 was opened, the slides (not shown) on the top drawer 75 broke, but the top drawer 75 remained open for several hours while the piece of furniture 70 remained secured to the wall 80.

Figure 15:
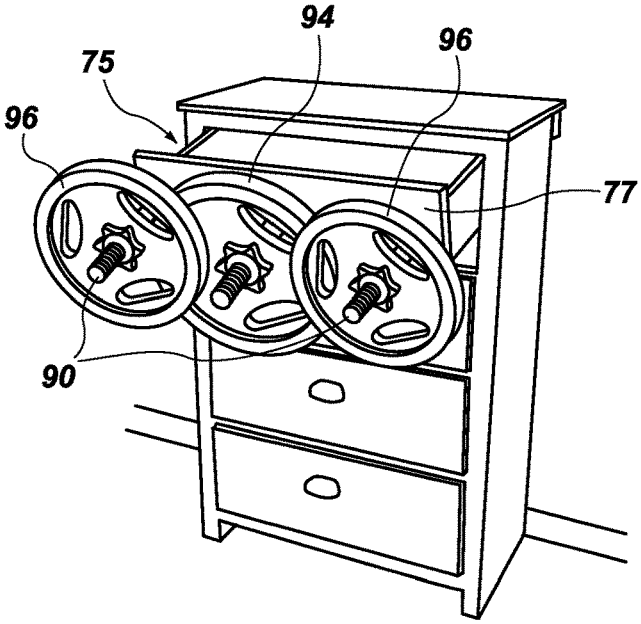
Figure 16:
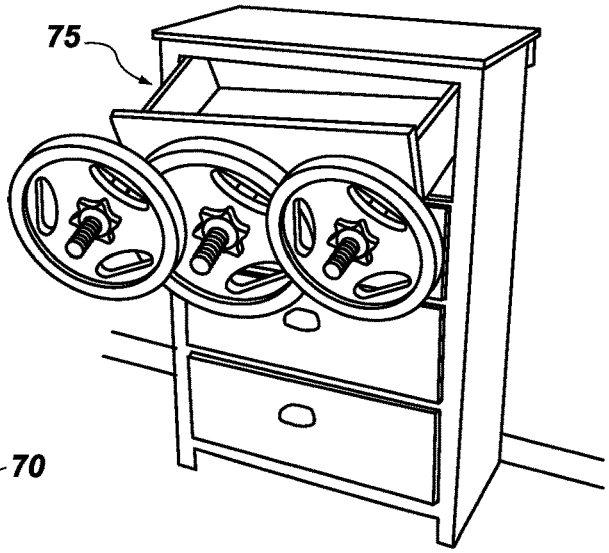
Figure 17:
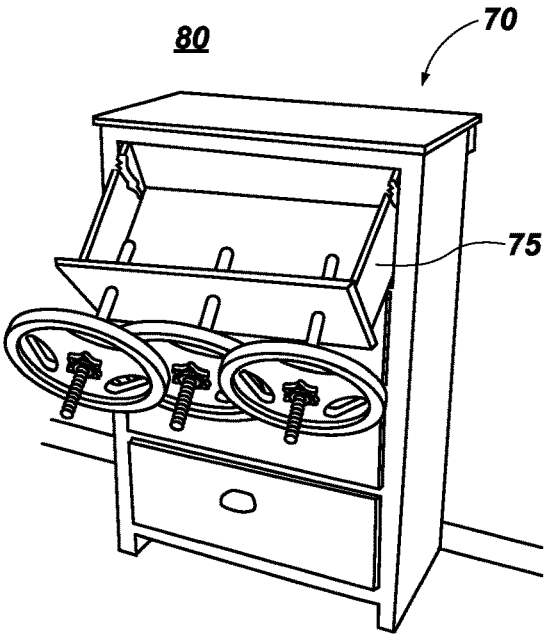

Next, as shown in FIG. 15, two additional barbell bars 90 of about five pounds (about 2.27 kg) each were added to the front panel 77 of the top drawer 75. A weight 94 of 50 pounds (about 22.7 kg) was placed on one of the barbell bars 90, while a weight 96 of 25 pounds (about 11.36 kg) was placed on each of other two of the barbell bars 90, for a total weight of about 115 pounds (about 52.3 kg) on the top drawer 75 (i.e., the weight of the three barbell bars 90, the two weights 94 of 25 pounds (about 11.36 kg) each, and the weight 96 of 50 pounds (about 22.7 kg). The combined weight of the barbell bars 90, the weights 94, and the weight 96 pulled the top drawer 75 out (forward) and down, as shown in FIG. 16, eventually breaking the top 75 drawer, as illustrated by FIG. 17. However, the securing strip 10 (FIGS. 9 and 10) that secured the piece of furniture 70 to the wall 80 prevented the piece of furniture 70 from tilting and falling away from the wall 80.

Figure 18:
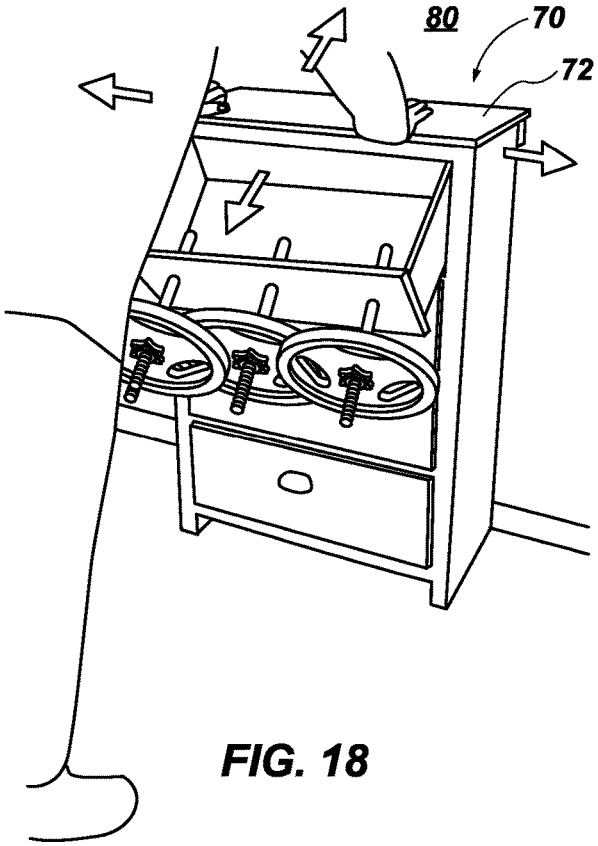

As shown in FIG. 18, the piece of furniture 70 was then shook for about three minutes and still remained secured to the wall 80.

The compressibility and optional elasticity of the elongated compressible element 20 (FIGS. 1-4) absorbs forces exerted on the piece of furniture 70. It is believed that the properties of the elongated compressible element 20, including its ability to absorb forces applied to one or both of the first side 22 and the second side 26 thereof (FIGS. 1-4), prevent the adhesive material 24, 28 (FIGS. 1-4) from having to absorb such forces and, thus, enable the adhesive material 24, 28 to remain secured to the backside 72 of the piece of furniture 70 and to the surface 82 of the wall 80.

It is advisable to inspect the elongated compressible element 20 and the adhesive material 24, 28 periodically (e.g., monthly, quarterly, semi-annually, annually, etc.) to ensure that they have not degraded or been damaged and that they continue to adequately secure the piece of furniture 70 to the wall 80.

Figure 19:
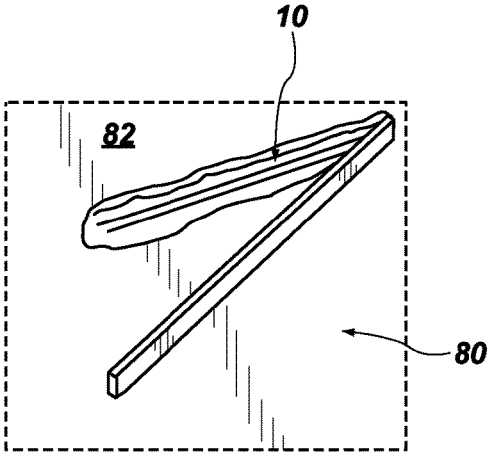
FIGS. 19 and 20 show removal of the securing strip from the wall.
Figure 20:
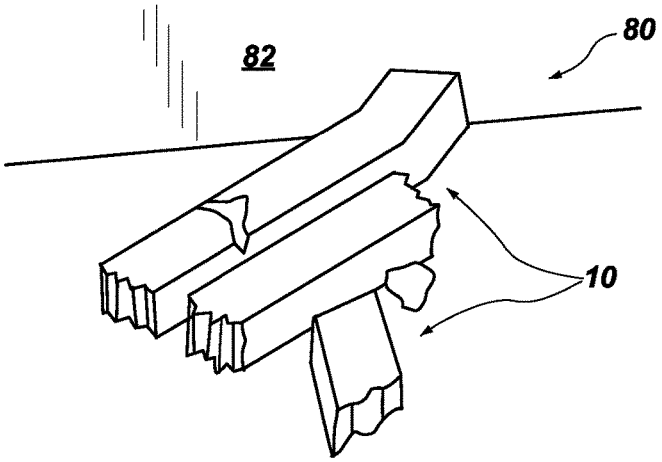

With reference to FIGS. 19 and 20, when movement, removal, or replacement of the piece of furniture 70 (FIG. 18) is desired, the securing strip 10 and the adhesive material 24 on the first side 22 of the elongated compressible element 20 (FIG. 6) may be removed from the backside 72 of the piece of furniture 70 (FIG. 6). In addition, the securing strip 10 and the adhesive material 28 on the second side 26 of the elongated compressible element 20 (FIG. 6) may be removed from the surface 82 of the wall 80. As the securing strip 10 is removed from the surface 82 of the wall 80, the adhesive material 28 may be pulled off of the surface 82 of the wall 80 without damaging the surface 82 and, in some embodiments, while leaving substantially no residue or no residue on the surface 82, as illustrated by FIG. 19. Due to the strength with which the adhesive material 28 secures the elongated compressible element 20 to the surface 82 of the wall 80, however, the securing strip 10 may be damaged as it is removed from the surface 82 of the wall 80, as shown in FIG. 20.

Figure 21:
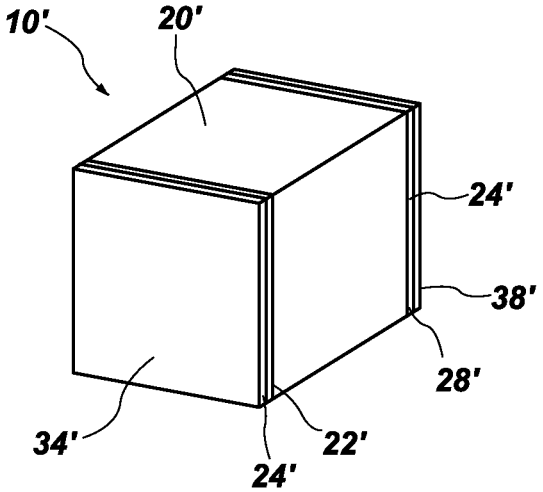
FIGS. 21 and 22 depict an embodiment of a securing pad according to this disclosure.
Figure 22:
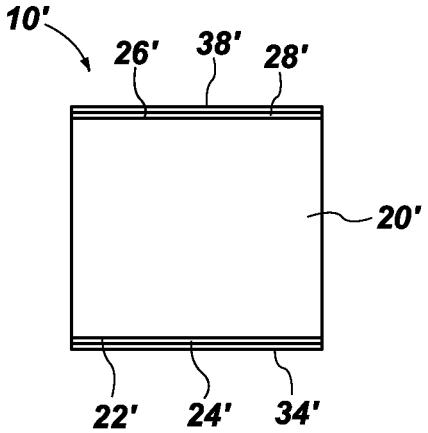

FIGS. 21 and 22 illustrate an embodiment of a securing pad 10' that includes a compressible element 20' with a first side 22' and a second side 26' opposite from the first side 22'. The first side 22' carries an adhesive material 24', while the second side 26' carries an adhesive material 28'. Release liners 34' and 38' may cover the adhesive materials 24' and 28', respectively.

The compressible element 20' may have the same properties and comprise the same materials that as the compressible element 20 of the embodiment of securing strip 10 described in reference to FIGS. 1-4. Without limitation, the compressible element 20' may comprise a compressible, elastic, resilient foam. The foam may be chemically and/or physically reinforced.

The compressible element 20' of the securing pad 10' may be short. The first surface 22' and the second surface 26' may have identical shapes and may define a shape of the compressible element 20'. As depicted, the compressible element 20' and its first surface 22' and second surface 26' may be square in shape. Alternatively, the compressible element 20' may have another polygonal shape (e.g., a regular polygonal, another polygon), a round shape (e.g., a circle, an oval, an ellipse, an egg shape, etc.), or another shape (e.g., a star polygon, a crescent shape, a heart shape, a smiley face shape, etc.).

The compressible element 20' may measure about one inch (about 2.5 cm) to about two inches (about 5 cm) across. The compressible element 20' may have a thickness (i.e., the distance from its first side 22' to its second side 26') of about a half an inch (about 1¼ cm) to about an inch (about 2½ cm) to about two inches (about 5 cm).

The adhesive material 24' and the release liner 34' of the securing pad 10' may have the same characteristics and comprise the same materials as the adhesive material 24 and the release liner 34, respectively, of the embodiment of securing strip 10 described in reference to FIGS. 1-4.

The securing pad 10' may be used in the same manner as the embodiment of securing strip 10, as illustrated by FIGS. 3-10. In addition, due to its size, the securing pad 10' may be used to secure pieces of furniture and other items of a variety of different shapes to a wall. Without limitation, securing pads 10' may be used to secure tall items, such as bookcases, grandfather clocks, curio cabinets, and the like to the walls against which they are to be positioned. Using the securing pads 10' in such a way may prevent an item that has been secured to a wall from being knocked over when impacted, shaken (e.g., as in an earthquake, under high winds, etc.), or when otherwise subjected to an external force.

Figure 23:
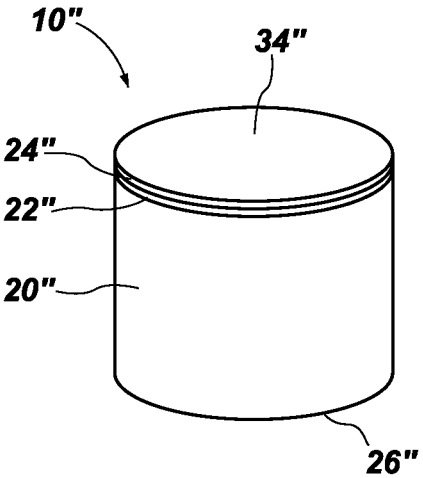
FIGS. 23 and 24 illustrate an embodiment of a protective pad according to this disclosure.
Figure 24:
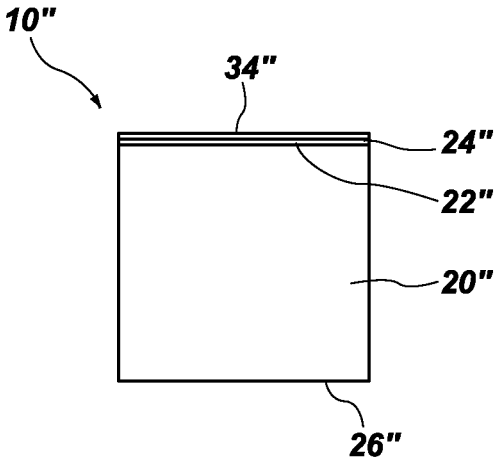

With reference now turned to FIGS. 23 and 24, an embodiment of a protective pad 10" is depicted. The protective pad 10" includes a compressible element 20" with a first side 22" and a second side 26" opposite from the first side 22". An adhesive material 24" may be present on the first side 22". A release liner 34" may be provided over the adhesive material 24". The second side 26" of the compressible element 20" may be exposed.

The compressible element 20" may have the same properties and comprise the same materials that as the compressible element 20 of the embodiment of securing strip 10 described in reference to FIGS. 1-4. Without limitation, the compressible element 20" may comprise a compressible, elastic, resilient foam. The compressible element 20" of the protective pad 10" need not have the same strength as the compressible element 20 of the securing strip 10, however.

The compressible element 20" of the protective pad 10" may be short. The first surface 22" and the second surface 26" may have identical shapes and may define a shape of the compressible element 20". As depicted, the compressible element 20" and its first surface 22" and second surface 26" may be circular in shape. Alternatively, the compressible element 20" may have another round shape (e.g., an oval, an ellipse, an egg shape, etc.), a polygonal shape (e.g., a regular polygonal, another polygon), or another shape (e.g., a star polygon, a heart shape, a smiley face shape, etc.).

The compressible element may measure about one inch (about 2.5 cm) to about two inches (about 5 cm) across. The compressible element 20" may have a thickness (i.e., the distance from its first side 22" to its second side 26") of about one inch (about 2.5 cm) to about two inches (about 5 cm).

The adhesive material 24" and the release liner 34" of the protective pad 10" may have the same characteristics and comprise the same materials as the adhesive material 24 and the release liner 34, respectively, of the embodiment of securing strip 10 described in reference to FIGS. 1-4. However, the adhesive material 24" of the protective pad 10" need not have the same adhesive strength as the adhesive material 24 of the securing strip 10.

In use, the release liner 34" may be removed from the adhesive material 24". The exposed adhesive material 24" on the first side 22" of the compressible element 20" may secure the protective pad 10" to a surface of a piece of furniture (e.g., the back of a headboard, etc.) that will face a wall. The furniture may then be positioned such that the second side 26" of the compressible element 20" faces the wall or is placed against the wall. Alternatively, the exposed adhesive material 24" on the first surface 22" of the compressible element 20" could secure the protective pad 10" to a wall that is to be protected from a piece of furniture, and then the piece of furniture may then be moved into place adjacent to or against the second surface 26" of the compressible element 20". As the furniture moves (e.g., as a child jumps into bed, etc.), the protective pad 10" may cushion impacts of the piece of furniture against the wall, which may protect one or both of the piece of furniture and the wall.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A method for preventing furniture resting on a floor from tilting away from a wall, comprising:

positioning a compressible element between a backside of the furniture and the wall, the backside of the furniture spaced apart from the wall by a base molding, a thickness of the compressible element enabling the compressible element to fill a gap between the backside of the furniture and the wall;

adhesively securing a front side of the compressible element to a top portion of the backside of the furniture;

adhesively securing a backside of the compressible element to the wall.

2. The method of claim 1, wherein positioning the compressible element comprises positioning a strip of foam between the backside of the furniture and the wall.

3. The method of claim 2, wherein positioning the strip of foam comprises positioning a strip of expanding foam.

4. The method of claim 2, wherein positioning the strip of foam comprises positioning a strip of polyurethane foam.

5. The method of claim 1, wherein adhesively securing the front side and adhesively securing the backside comprise using adhesive coatings on the front side and the backside of the compressible element.

6. The method of claim 1, wherein adhesively securing the front side and adhesively securing the backside comprise using an acrylic adhesive.

7. The method of claim 1, wherein using an acrylic adhesive comprises using a conformable acrylic adhesive.

8. The method of claim 1, further comprising:

exerting a force on the furniture in a forward and downward direction, adhesive on the front side of the compressible element and adhesive on the backside of the compressible element preventing the furniture from tipping away from the wall.

9. The method of claim 8, wherein exerting the force comprises exerting a force of up to 50 pounds.

10. The method of claim 1, further comprising:

reinforcing a manner in which the backside of the furniture is secured to a remainder of the furniture.

11. The method of claim 1, further comprising:

removing the compressible element from the wall without damaging a surface of the wall.

12. The method of claim 11, wherein removing the compressible element from the wall comprises removing the compressible element from the wall while leaving substantially no adhesive residue on the wall.

13. The method of claim 1, wherein positioning the compressible element comprises positioning a compressible element that will withstand a force that would otherwise cause the furniture to tilt away from the wall.

14. The method of claim 13, wherein positioning the compressible element comprises positioning a compressible element that will withstand a force of up to 50 pounds that would otherwise cause the furniture to tilt away from the wall.

15. The method of claim 13, wherein positioning the compressible element comprises positioning a compressible element that will withstand a force of up to 75 pounds that would otherwise cause the furniture to tilt away from the wall.

16. The method of claim 13, wherein positioning the compressible element comprises positioning a compressible element that will withstand a force of up to 75 pounds that would otherwise cause the furniture to tilt away from the wall.

17. The method of claim 1, wherein positioning the compressible element comprises positioning a compressible element with a reinforcing thread extending through a thickness of the compressible element.

18. The method of claim 17, wherein positioning the compressible element comprises positioning a compressible element with the reinforcing thread following a serpentine path through the thickness extending through the thickness of the compressible element.

19. The method of claim 18, wherein positioning the compressible element comprises positioning a compressible element with the reinforcing thread extending partially over the front side of the compressible element and partially over the backside of the compressible element.

20. The method of claim 17, wherein positioning the compressible element comprises positioning a compressible element with the reinforcing thread comprising poly-para-phenylene terephthalamide.

* * * * *